US007051890B2

(12) United States Patent
Onoda et al.

(10) Patent No.: US 7,051,890 B2
(45) Date of Patent: May 30, 2006

(54) SYNTHETIC RESIN BOTTLE WITH CIRCUMFERENTIAL RIBS FOR INCREASED SURFACE RIGIDITY

(75) Inventors: Yuko Onoda, Ibaraki (JP); Tomoyuki Ozawa, Koto-ku (JP); Takao Iizuka, Koto-ku (JP); Shigeru Tomiyama, Koto-ku (JP); Tadayori Nakayama, Matsudo (JP); Fuminori Tanaka, Matsudo (JP); Tsutomu Asari, Matsudo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 28 days.

(21) Appl. No.: 10/498,702

(22) PCT Filed: Mar. 27, 2003

(86) PCT No.: PCT/JP03/03802

§ 371 (c)(1),
(2), (4) Date: Jul. 20, 2004

(87) PCT Pub. No.: WO03/080452

PCT Pub. Date: Oct. 2, 2003

(65) Prior Publication Data

US 2005/0029220 A1 Feb. 10, 2005

(30) Foreign Application Priority Data

Mar. 27, 2002 (JP) ..... 2002-088301

(51) Int. Cl.
*B65D 1/02* (2006.01)
*B65D 1/46* (2006.01)

(52) U.S. Cl. ..... 215/383; 215/382; 220/672; 220/675

(58) Field of Classification Search ..... 215/379, 215/381–383; 220/669, 671, 672, 675
See application file for complete search history.

(56) References Cited

U.S. PATENT DOCUMENTS 3,225,950 A * 12/1965 Fulcher et al. ..... 215/384
3,286,902 A * 11/1966 Hunter et al. ..... 229/406
4,497,855 A * 2/1985 Agrawal et al. ..... 428/36.92
4,610,366 A * 9/1986 Estes et al. ..... 426/106
5,067,622 A * 11/1991 Garver et al. ..... 215/381
5,690,244 A * 11/1997 Darr ..... 215/382
6,230,912 B1 * 5/2001 Rashid ..... 215/383

(Continued)

FOREIGN PATENT DOCUMENTS

GB 2025889 A * 1/1980

(Continued)

*Primary Examiner*—Sue A. Weaver
(74) *Attorney, Agent, or Firm*—Oliff & Berridge, PLC

(57) ABSTRACT

The technical problem of this invention is to eliminate the need to use deformable panel walls and to find the body of a shape that no false deformation, such as dented deformation, takes place in a portion of the body due to the hot filling of the contents or the reduced pressure created by the treatment of retort-packed foods. The object of this invention is to obtain a bottle that can inhibit the deformation caused by reduced pressure, has a high buckling strength, and is good in outer appearance. As the solution, there is provided a biaxially drawn, blow-molded bottle made of a synthetic resin, in which the surface rigidity of the wall of body is set in such a manner that a part of the body wall cannot become dented inward under a reduced inner pressure of at least 350 mmHg (46.7 kPa).

8 Claims, 5 Drawing Sheets

U.S. PATENT DOCUMENTS

| | | | | |
|---|---|---|---|---|
| 6,296,131 | B1 * | 10/2001 | Rashid | 215/383 |
| 2002/0074336 | A1 * | 6/2002 | Silvers | 220/623 |
| 2002/0153343 | A1 * | 10/2002 | Tobias et al. | 215/375 |
| 2003/0000911 | A1 * | 1/2003 | kelley et al. | 215/381 |
| 2004/0173565 | A1 * | 9/2004 | Semersky et al. | 215/382 |

FOREIGN PATENT DOCUMENTS

| | | |
|---|---|---|
| JP | A 57-199511 | 12/1982 |
| JP | A 9-272523 | 10/1997 |
| JP | A 10-264918 | 10/1998 |
| JP | A 2000-229614 | 8/2000 |

* cited by examiner

SYNTHETIC RESIN BOTTLE WITH CIRCUMFERENTIAL RIBS FOR INCREASED SURFACE RIGIDITY

TECHNICAL FIELD

This invention relates to a biaxially drawn, blow-molded bottle made of a synthetic resin, especially made of a polyethylene terephthalate resin for use in hot filling of the contents.

BACKGROUND OF THE INVENTION

The biaxially drawn, blow-molded bottle of a polyethylene terephthalate resin (hereinafter referred to as the PET resin) can be given a thin and uniform wall thickness because of distinguished characteristics of PET. Since such bottles are economical, have high resistance to contents and a high mechanical strength, and have good outer appearance, the bottles are widely used as liquid containers in various fields.

As described above, the PET bottle has a high mechanical strength despite its thin wall. However, since the body, a major part of the bottle, has a thin wall, the bottle is inconvenient in that a part of the body may falsely become dented and deform under a reduced pressure created inside the bottle and may give a marked damage to the outer appearance of the bottle. As a commercial product, the bottle may be quite poor in appearance.

Especially in recent years, widely spreading applications require the bottles to be hot-filled with beverages at a temperature in the range of 85 to 95° C. After the hot filling, the bottles are found to be at a greatly reduced inner pressure once the bottles have been cooled. Thus, there is an ever-increasing request for the bottles that can be prevented from being deformed under such a reduced pressure.

In the applications requiring sterilization of retort-packed foods, e.g., by heating the foods at 121° C. for 30 minutes after the bottle has been filled with the contents, the resin for molding the bottle must be resistant to this temperature, and in addition, the bottle should be able to stand up to severe depressurization.

In order for the PET bottle to be protected from the disadvantage of deformation under reduced pressure, various proposals have been made for the PET bottles. For instance, utility model laid open No. 1982-199511 discloses a number of deformable, slightly hollowed panel walls, which are disposed in the body of the bottle and easily become further dented inward so as to absorb a negative pressure created inside the bottle. Since the deformable panels become dented to a certain shape, other portions of the body are protected from false dented deformation under reduced pressure. Thus, the body of the bottle is prevented from showing poor outer appearance.

However, the deformable panel walls in the above-described conventional art has a problem in that the extent to which negative pressure can be absorbed is not sufficient, considering the extent of dented deformation created under the reduced pressure. This is because the deformable panels have been molded beforehand simply in the shape slightly dented inward so that the dented deformation may occur easily under the reduced pressure created inside the bottle.

Another problem of the deformable panel walls is that the body has a decreased buckling strength due to the existence of these deformable panels, which are molded by denting and deforming a part of the walls and which are equally spaced in a row around the circumference of the body.

Still another problem of the deformable panels is that the bottle sometimes looks poor in appearance. Since the deformable panel walls that become dented are longer than are wide, the portion of the body surrounded by the deformable panels looks quite lean as compared with other portions of the body, depending on the angle from which the bottle is viewed.

Lastly, there is a problem that the bottle becomes permanently deformed. All of those bottles causing a reduced pressure to be created inside are filled with hot liquid contents. Initially when the bottle is filled with the hot contents and sealed, the inside of the bottle is put under a pressurized condition. Therefore, the deformable panel walls are also required to have an ability to absorb a pressure, in addition to the ability to absorb a reduced pressure. Since these deformable panel walls have a shape of simply curved and dented panels, the panels cannot fully absorb the pressure. If a large pressure is applied, the deformable panels are not elastically inflated but are reversibly projected, and remain permanently deformed.

In spite of these many difficulties, fact is that the above-described deformable panels have been and are used in the bottles in most cases where an especially severe reduced pressure is derived from the hot filling using a temperature in the range of 85 to 95° C.

This invention has been made to solve the above-described problems observed in the conventional art. Thus, the technical problem of this invention is to eliminate the need to use the deformable panel walls and to find the body of such a shape that no false deformation, such as dented deformation, takes place in a portion of the body due to the hot filling or the reduced pressure created after the treatment of retort-packed foods. The object of this invention is to obtain a bottle that can inhibit the deformation caused by reduced pressure, has a high buckling strength, and is good in outer appearance.

DISCLOSURE OF THE INVENTION

The means of carrying out the invention of claim 1 to solve the above-described technical problems comprises that the surface rigidity of the body wall has been set in such a manner that a part of the body wall never becomes dented inward under a reduced inner pressure of at least 350 mmHg (46.7 kPa).

The above-described configuration of claim 1 is intended to make the body wall resist a lateral pressure applied onto the wall surface when such a pressure is created in the hot filling process by a reduced pressure of at least 350 mmHg (46.7 kPa). This can be achieved by raising the surface rigidity of the body wall to a high level, without providing the deformable panel walls in which a portion of the body wall becomes dented and deforms as found in the conventional art.

In this configuration, the surface rigidity of the body wall is at work to inhibit the deformation under reduced pressure. Thus, it is possible with this configuration to deal with such problems as the deficient dented deformation, insufficient buckling strength, poor outer appearance, and the occurrence of permanent inverted deformation, all of which are caused by the adoption of deformable panels. Bottles that can be obtained eliminate the need for deformable panels, have quite a new appearance, and are of an elaborate design that differs from the designs used in conventional art.

The synthetic resin bottle of this invention is a biaxially drawn, blow-molded bottle made of especially a PET resin. If necessary, however, polyethylene naphthalate (PEN) or the MXD-6 nylon resin can be blended with the PET resin to improve, for instance, heat-resisting property and gas barrier property, within the range in which the nature of the PET resin is not impaired. In another method, PEN or MXD-6 can be laminated as an inner layer between the PET resin layers.

The means of carrying out the invention of claim 2 exists in the configuration that the body has a cylindrical shape.

In the configuration of claim 2 where the bottle has a cylindrical shape, the body wall outwardly forms a convex surface, which gives high surface rigidity to the entire body.

The means of carrying out the invention of claim 3 includes the invention of claim 1, and also comprises that the body is in a regular polygonal shape having at least 8 corners.

In the configuration of claim 3, the body shape is not limited to a cylindrical shape, but a regular polygonal shape can also be used, provided that the regular polygon has 8 or more corners. The reason is that, with a regular polygon having 7 corners or less, each of the flat panel wall surfaces disposed around the body has laterally such a large width that the panel tends to become dented and deform easily under reduced pressure.

The means of carrying out the invention of claim 4 exists in the configuration that, in the invention of claim 2 or 3, two or more groove-like ribs are disposed circumferentially around the body. Among the circumferential ribs, the uppermost rib is disposed at the upper end of the body near the border with the shoulder that has a roughly truncated conical shape. The lowermost rib is disposed at the lower end of the body. Distance H between two adjacent ribs is set at a length in the range of 0.2D to 0.6D where D indicates the diameter of the cylindrical body or the length of a diagonal line of the cylindrical body having a regular polygonal shape.

In the configuration of claim 4, the uppermost circumferential rib is disposed at the upper end of the body near the border with the shoulder that has a roughly truncated conical shape. Therefore, it is possible to inhibit effectively the dented deformation, which is apt to take place on or near this border.

The body can be equipped with a number of circumferential ribs, including those disposed at the upper end and the lower end of the body, so that the body wall has an increased level of surface rigidity.

The circumferential ribs are required to resist the lateral pressure created under reduced pressure. The interval between two adjacent ribs can be set advantageously at 0.6D or less though it depends on the thickness of the body wall. At this interval, increased surface rigidity can be achieved for the same thickness as that of the hot-filled bottles provided with conventional deformable panels. At the interval of 0.2D or less, the circumferential ribs are too close to adjacent ribs, resulting in the lack of smooth outer surface. Under this condition, the body of the bottle is found inconvenient to attach a label. If the bottle is covered with shrink film, the body is also inconvenient to clearly show the name of the merchandise or to decorate the bottle.

The means of carrying out the invention of claim 5 exists in the configuration that, in the invention of claim 4, the distance H between two adjacent ribs is set at a length in the range of 0.3D to 0.45D.

In the above-described configuration of claim 5, the bottle is allowed to have a thinner wall than the bottle in conventional art. At the same wall thickness, the bottle according to claim 5 can be used at a higher hot-filling temperature or under a severer pressure condition than in conventional art. The circumferential ribs can be disposed in a smaller number, which gives the bottle preferable outer appearance.

The means of carrying out the invention of claim 6 exists in the configuration that, in the invention of claim 1, 2, 3, 4, or 5, the wall of the body excluding the neck has a minimum thickness of 300 μm or more.

In the above-described configuration of claim 6, the surface rigidity of the bottle can be raised by giving a large thickness to the bottle, but the wall thickness has a limit of its own because of preform productivity, the increase in material cost, and an increased bottle weight. A suitable wall thickness is a minimum of 300 μm or more, and preferably ranges from 350 to 650 μm on an average. At a thickness less than 300 μm, it becomes difficult to secure the surface rigidity that can resist the depressurization.

PREFERRED EMBODIMENTS OF THE INVENTION

Figure 1:
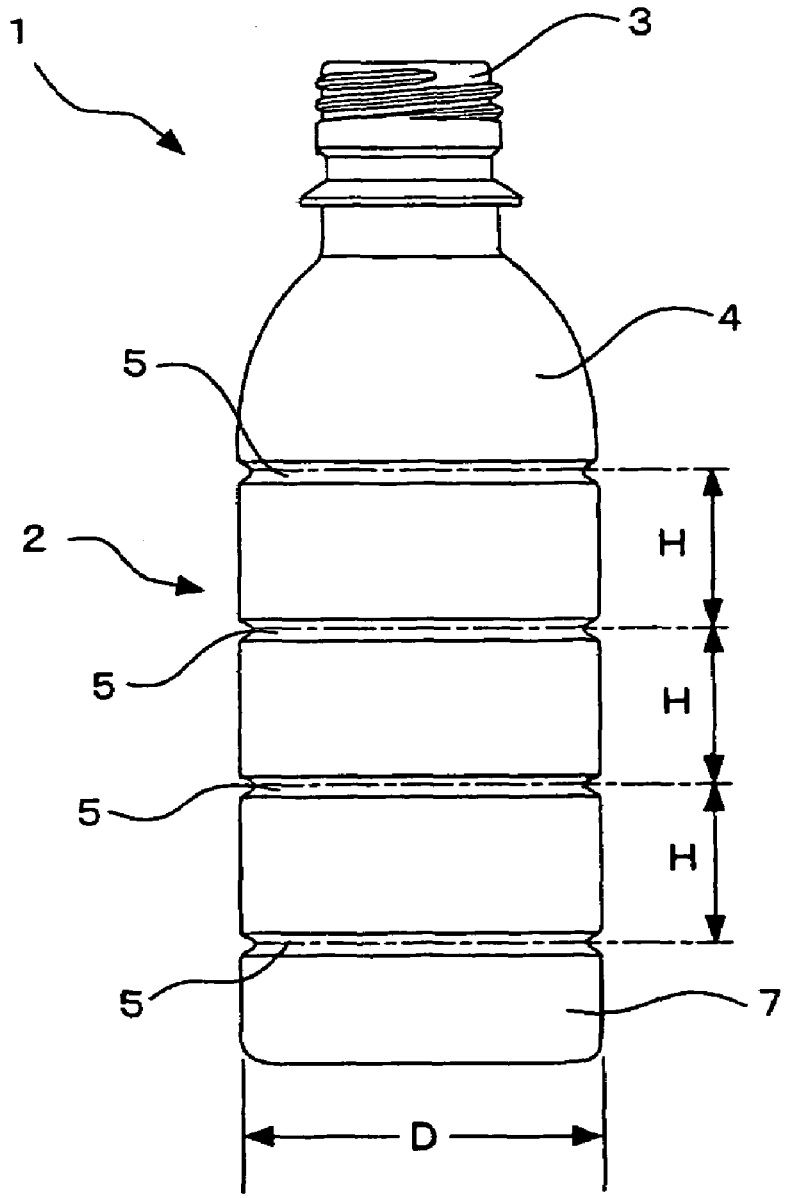
FIG. 1 is a front elevational view of an entire synthetic resin bottle in the first embodiment of this invention.

This invention is further described with respect to preferred embodiments, now referring to the drawings. FIG. 1 is a front view of an entire synthetic resin bottle in the first embodiment of this invention. It is an ordinary 200-ml PET bottle, which has been biaxially drawn and blow-molded. In its structure, the bottle comprises cylindrical body 2, shoulder 4 of a truncated conical shape disposed at the upper end of the body 2, short cylindrical neck 3 disposed on the shoulder 4, and bottom 7 at the lower end of the body 2. The bottle 1 has the cylindrical body 2 with a diameter of 54 mm, and has a total bottle height of 140 mm. The body 2 has an average thickness of 350 μm and a minimum thickness of at least 300 μm.

The body 2 is provided with a total of four circumferential ribs 5 having a cross-section of almost U-shape. Among these ribs, the uppermost rib is disposed at the upper end of the body 2 near the border with the shoulder 4. The lowermost rib is disposed at the lower end of the body 2 near the border with the bottom 7. The distance H between two adjacent ribs 5 is 24 mm (0.44D).

Figure 2:
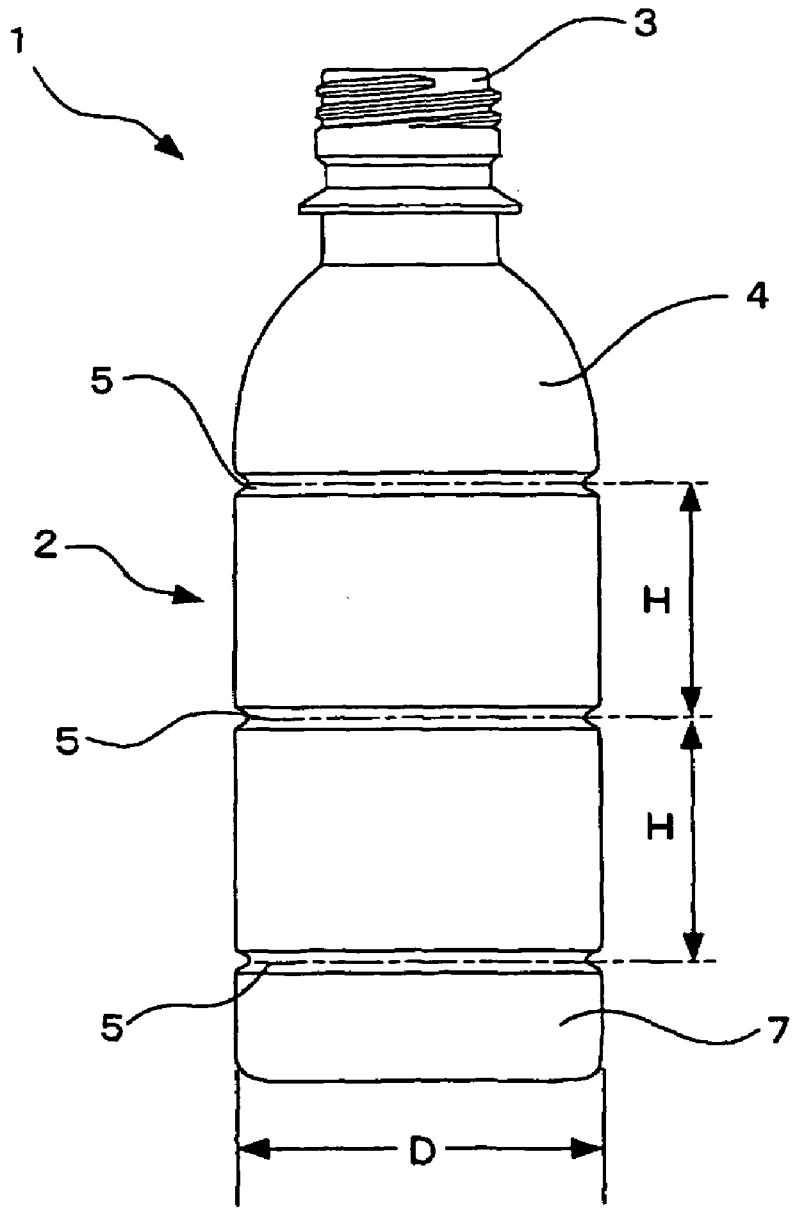
FIG. 2 is a front elevational view of an entire synthetic resin bottle in a comparative example as compared with the first embodiment shown in FIG. 1.

FIG. 2 shows a bottle of a comparative example having three circumferential ribs 5, the least number of ribs as compared to the first embodiment. The distance H is 36 mm (0.67D).

The bottle of the first embodiment and the bottle of the comparative example were put to a hot-filling test at 87° C. After the bottles 1 were cooled down to room temperature, they were checked for deformation. No dented deformation was observed in the bottle 1 of the first embodiment. On the other hand, the bottle 1 of the comparative example showed notable dented deformation in the wall of the body 2.

The bottle of the first embodiment was also put to one more test conducted at 95° C. No dented deformation was likewise observed in the bottle 1 of the first embodiment as was in the test conducted at 87° C.

The above-described bottles 1 of both the first embodiment and the comparative example were measured for depressurization strength. The neck 3 of the bottles 1 was sealed, and the bottles 1 were gradually depressurized, using a vacuum pump. The extent of depressurization is defined as the depressurization strength (mmHg, kPa) measured at the time when a part of the wall surface of the body 2 becomes sharply dented and deforms. The bottle 1 of the first embodiment had a depressurizing strength of 360 mmHg (48.0 kPa), and the bottle 1 of the comparable example had a corresponding strength of 310 mmHg (41.3 kPa).

As described above, the results of the tests with the bottle 1 of the first embodiment indicate that, if there is a distance H of 0.43D between two adjacent circumferential ribs, the bottle 1 of the first embodiment has the surface rigidity enough to be able to cope with the pressure reduction of at least 350 mmHg (46.7 kPa) at an average wall thickness of 350 μm, which is similar to the wall thickness of conventional bottles now in use. It is also found that the bottle 1 of the first embodiment is fully capable of inhibiting the dented deformation caused by the pressure reduction during the hot-filling process using a temperature even in the range of 85 to 95° C.

Bottles used for retort-packed foods are thermally treated at 121° C. for 30 minutes. Highly heat-resistant PET bottles are used in such an application, and these bottles are molded by the so-called "double blow" method (See patent publication No. 1992-56734).

More particularly, the above-described double blow molding method comprises a primary blow-molding step, in which preform having a predetermined shape is biaxially drawn and blow-molded into the primary intermediate product, a step of heating the primary intermediate product to shrink it thermally and to mold it into the secondary intermediate product, and lastly a secondary blow-molding step to mold the secondary intermediate product into a bottle. The primary intermediate product is heated and is subjected to thermal shrinkage because this heating step serves to eliminate the residual strain that has been created within the primary intermediate product and to obtain a highly crystallized and quite highly heat-resisting bottle.

Figure 3:
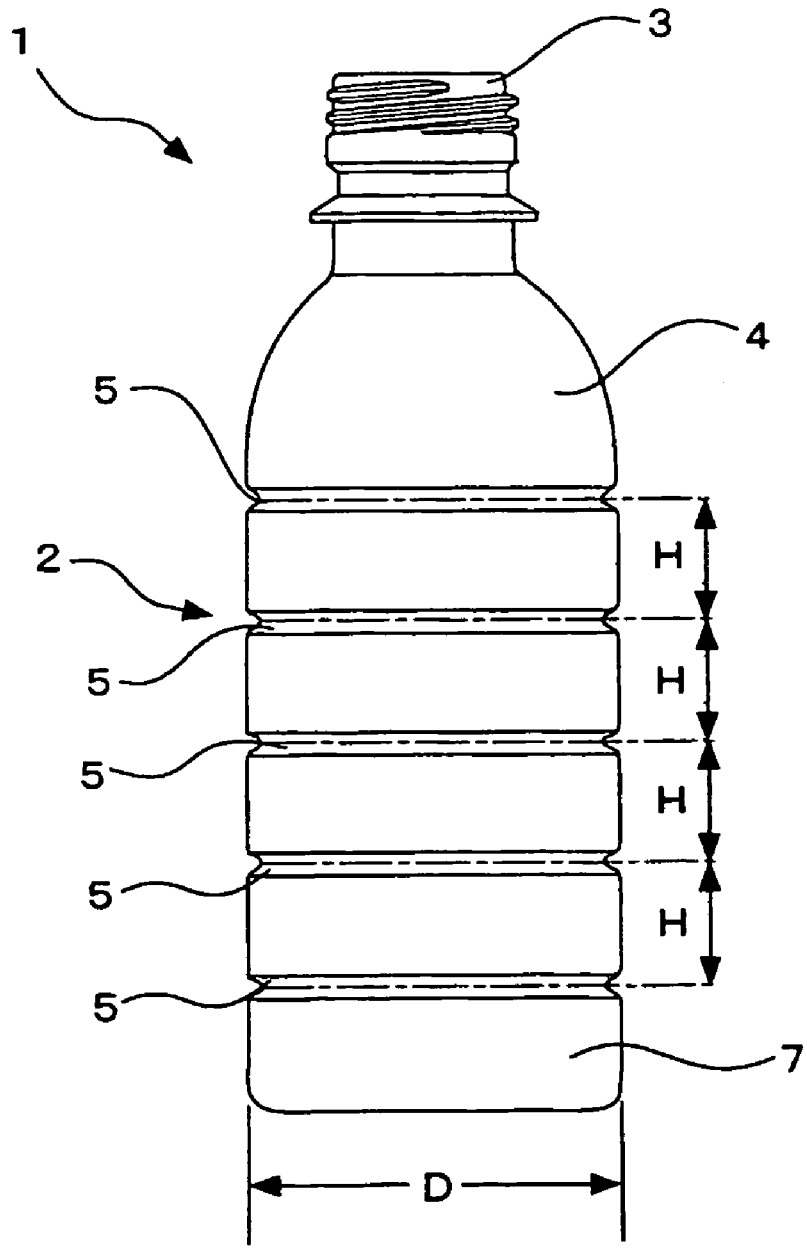
FIG. 3 is a front elevational view of an entire synthetic resin bottle in the second embodiment of this invention.

FIG. 3 shows a synthetic resin bottle in the second embodiment of this invention. The bottle 1 has been molded under the conditions of a primary mold temperature of 180° C., a heating temperature of 230° C., and a secondary mold temperature of 140° C., so that the bottle 1 can respond to the retort treatment where the bottle and the contents are heat-treated at a temperature of 121° C. for 30 minutes. The bottle 1 has an average wall thickness of 400 μm, as compared to 350 μm in the bottle of the first embodiment, and is provided with five circumferential ribs 5 that are spaced equally, so that the surface rigidity is increased further. The circumferential ribs have the distance H of 18 mm (0.33D) between two adjacent ribs 5.

The bottle 1 of the second embodiment was filled with the contents, and the retort-packed bottle was heat-treated at 121° C. for 30 minutes. The bottle 1 was then cooled down to room temperature and was checked for any deformation. No dented deformation was observed. This bottle 1 had a depressurizing strength of 525 mmHg (70.0 kPa). Even for the pressure reduction derived from the treatment at such a high temperature, sufficient surface rigidity can be secured within the range of wall thickness that is permissible for the bottle, by setting a suitable distance H between two adjacent circumferential ribs 5.

The shape of this bottle obviously allows the bottle to be applicable also as an ordinary hot-filling bottle that has been biaxially drawn, blow-molded and can be heat-treated at a temperature in the range of 85 to 95° C. This shape of the bottle is not limited merely to the use as the retort-treated bottle.

Figure 4:
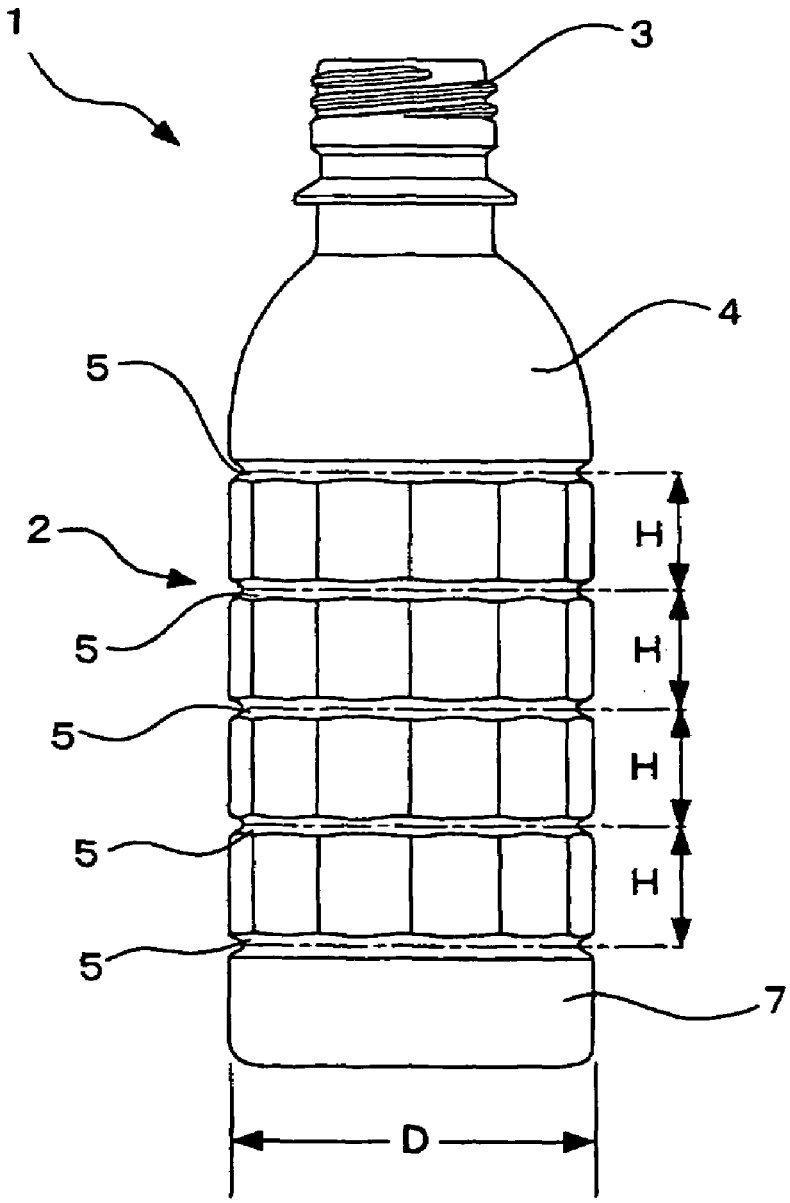
FIG. 4 is a front elevational view of an entire synthetic resin bottle in the third embodiment of this invention.

FIG. 4 shows a synthetic resin bottle in the third embodiment of this invention. The bottle has an average wall thickness of 350 μm, the cylindrical body 2 with the cross-section of a regular dodecagonal shape, a diagonal length of 54 mm, and five circumferential ribs 5 that are spaced equally. There was no dented deformation that was caused by the hot filling at a temperature of 87° C.

The circumferential ribs 5 are spaced equally in all of the first, second, and third embodiments. However, it is noted that these ribs need not necessarily be spaced equally. If they are not spaced equally, the purpose of this patent application can be achieved at the widest distance H in the range of 0.2D to 0.6D, and more preferably in the range of 0.3D to 0.45D, between two adjacent circumferential ribs 5.

Figure 5:
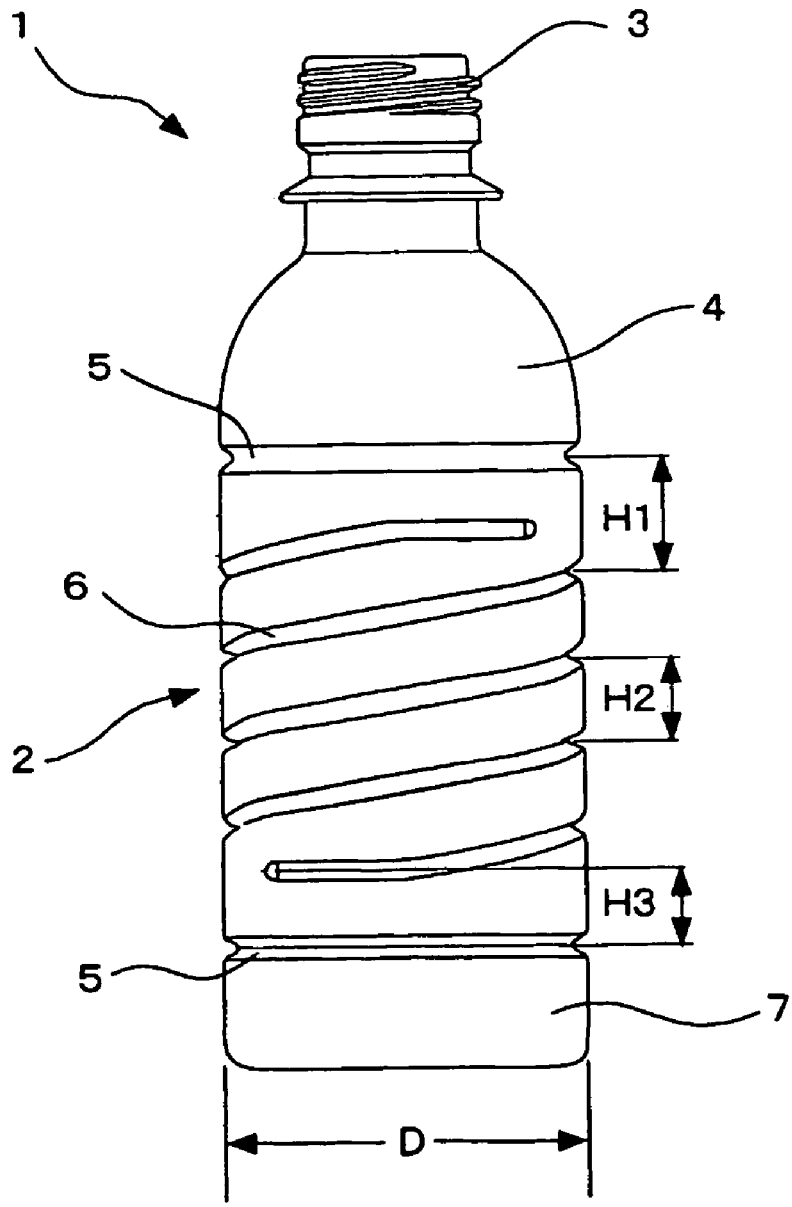
FIG. 5 is a front elevational view of an entire synthetic resin bottle in the fourth embodiment of this invention.

FIG. 5 shows a synthetic resin bottle in the fourth embodiment of this invention. Two circumferential ribs 5 are disposed at the upper end and the lower end, respectively, of the body 2. Between these two ribs, a spiral rib 6 is dug in the wall as a variation of the third circumferential rib 5, but has the same cross-sectional structure as other ribs 5. Thus, the bottle of the third embodiment gives a new appearance of unique design.

Like this embodiment, the circumferential ribs 5 need not necessarily be prepared separately, but the spiral rib 6 in the fourth embodiment may be adopted within the realm of surface rigidity that can be effectively strengthened. At that time, only the distances H1, H2, and H3 shown in FIG. 5 need be taken into consideration. In this embodiment, the widest distance H1 is 27 mm (0.5D).

The body in the fourth embodiment had a diameter D of 54 mm and an average wall thickness of 350 μm. There was no dented deformation that was caused by the hot filling at the temperature of 87° C.

In order for the circumferential ribs 5 to give the right surface rigidity in all the above-described embodiments, it is preferred that these ribs are 1 mm or more in width and depth.

The PET bottles with a capacity of 200 ml were used in the tests for each embodiment. It goes without saying, though, that the bottle capacity is not set down specifically as long as the bottles meet the requirements described above.

INDUSTRIAL APPLICABILITY

This invention having the above-described configuration has the following effects:

In the configuration of the invention of claim 1, the surface rigidity of the body wall is at work to inhibit the deformation caused by the depressurization during the hot-filling process. This configuration enables the bottle to cope with such problems as the deficient dented deformation, insufficient buckling strength, poor outer appearance, and the occurrence of permanent inverted deformation under the pressurized condition, all of which are caused by the adoption of deformable panels. In addition, bottles that can be obtained eliminate the need for deformable panels, have quite a new appearance, and are of an elaborate design that differs from the designs in the conventional art.

In the invention of claim 2, the body has a cylindrical shape. This gives the bottle wall a convex shape over all the body surfaces and keeps the entire body at a high surface-rigid state.

In the invention of claim 3, the body is a cylinder of a regular polygonal shape having at least 8 corners. Such a shape makes it possible to avoid a large decrease in the surface rigidity and to obtain a bottle of unique design having a cylindrical body of the regular polygonal shape.

In the invention of claim 4 or 5, two or more circumferential ribs are disposed around the body, and the distance H between two adjacent ribs is set in a certain range. With this configuration, it is possible to increase the surface rigidity of the body to a level enough to resist the reduced pressure created during the hot-filling process.

In the invention of claim 6, suitable surface rigidity can be secured by setting the wall thickness at a minimum of 300 μm or more. In addition, when the bottle wall is set at an average thickness in the range of 350 to 650 μm, the suitable surface rigidity can be secured while maintaining the preform productivity and restricting the material cost and the increased bottle weight.

The invention claimed is:

1. A biaxially drawn, blow-molded bottle made of a synthetic resin, comprising at least two groove-like ribs cut circumferentially into a body of said bottle, with an uppermost circumferential rib being disposed at an upper end of the body near a border with a shoulder in a roughly truncated conical shape, and a lowermost circumferential rib being disposed in a lower portion of the body, wherein a distance H between two adjacent ribs is set at a length in a range of 0.2D to 0.6D where D indicates a diameter of a cylindrical body or a length of a diagonal line of a body having a regular polygonal shape, and wherein plane rigidity of a body wall is set in such a manner that a part of said body wall cannot be sunken inward at a reduced inner pressure of at least 350 mmHg (46.7 kPa).

2. The synthetic resin bottle according to claim 1, wherein the body of said bottle has a cylindrical shape.

3. The synthetic resin bottle according to claim 2, wherein the wall of the body other than at a neck portion has a minimum thickness of 300 μm or more.

4. The synthetic resin bottle according to claim 1, wherein the body of said bottle is in a regular polygonal shape having at least 8 corners.

5. The synthetic resin bottle according to claim 4, wherein the wall of the body other than at a neck portion has a minimum thickness of 300 μm or more.

6. The synthetic resin bottle according to claim 1, wherein the distance H between two adjacent circumferential ribs is set at a length in a range of 0.3D to 0.45D.

7. The synthetic resin bottle according to claim 6, wherein the wall of the body other than at a neck portion has a minimum thickness of 300 μm or more.

8. The synthetic resin bottle according to claim 1, wherein the wall of the body other than at a neck portion has a minimum thickness of 300 μm or more.

* * * * *